United States Patent [19]

Fecske

[11] 4,426,283

[45] Jan. 17, 1984

[54] MONO HYDROCYCLONE SEPARATOR

[75] Inventor: Aurel J. Fecske, Huddinge, Sweden

[73] Assignee: Alfa-Laval AB, Tumba, Sweden

[21] Appl. No.: 338,560

[22] Filed: Jan. 11, 1982

[30] Foreign Application Priority Data

Apr. 28, 1981 [DE] Fed. Rep. of Germany ..... 3116873

[51] Int. Cl.[3] ..... B04C 5/4

[52] U.S. Cl. ..... 209/211; 210/512.2

[58] Field of Search ..... 209/211, 144; 55/349; 210/512.2; 285/332.1

[56] References Cited

U.S. PATENT DOCUMENTS

| | | | |
|---|---|---|---|
| 1,651,016 | 11/1927 | Cotton | 285/332.1 |
| 3,261,467 | 7/1966 | Wikdahl | 209/211 |
| 3,861,532 | 1/1975 | Skardal | 209/211 |
| 3,959,150 | 5/1976 | Frykhult | 210/512.2 |
| 3,984,308 | 10/1976 | Rastatter | 209/211 |
| 4,155,839 | 5/1979 | Seifert et al. | 209/211 |
| 4,189,377 | 2/1980 | Dahlberg et al. | 209/211 |

FOREIGN PATENT DOCUMENTS

| | | | |
|---|---|---|---|
| 2150737 | 4/1973 | Fed. Rep. of Germany | 55/349 |
| 80059 | 11/1955 | Netherlands | 209/211 |
| 607777 | 9/1948 | United Kingdom | 209/211 |

*Primary Examiner*—Tim R. Miles

*Attorney, Agent, or Firm*—Cyrus S. Hapgood

[57] ABSTRACT

A multiple hydrocyclone separator comprises a pair of spaced concentric standpipes mounting a series of mono hydrocyclones each having a body containing a separating chamber and provided with first and second cylindrical external parts on opposite ends of the body. The body has a tangential inlet to the chamber and a first axial outlet formed by a third part screwed into the larger end of the body, the body forming a second axial outlet at its smaller end. Sealing rings are located in grooves in the respective cylindrical parts and seal against the walls defining openings in the respective standpipes. To secure the body, a nut on its smaller end clamps the adjacent standpipe against a collar of the body. Thus, the cylindrical part at the larger end of the body can slide with its sealing ring in the hole of the corresponding standpipe, thereby accommodating thermal expansion and contraction of the body while maintaining the sealing action of the sealing rings. Also, any of the mono cyclones can be readily replaced with one of different capacity to provide the multiple cyclone separator with a wide range of capacities.

5 Claims, 3 Drawing Figures

MONO HYDROCYCLONE SEPARATOR

This invention relates to hydrocyclone separators of the type comprising a series of mono hydrocyclone separators held together in an assembly having common inlet means and common outlets. Examples of this type are disclosed in U.S. Pat. No. 4,189,377 dates Feb. 19, 1980.

BACKGROUND OF THE INVENTION

As disclosed in said patent, a group of the mono hydrocyclones is formed by casting them in a molded annular block so that they are held together like the spokes of a wheel, and a plurality of such blocks are stacked in a pile to form the assembly, which may be termed a multiple cyclone separator.

It has been found that such multiple cyclones have certain disadvantages. In particular, they are poorly suited for uses where changes in capacities or flow characteristics are desired occasionally. This is so because although a molded block may be replaced by one of different capacity of flow characteristic, the individual mono cyclones in the block itself cannot be replaced.

Accordingly, it is an object of this invention to provide a mono hydrocyclone separator which can be readily exchanged for another in a multiple cyclone separator.

BRIEF DESCRIPTION OF THE INVENTION

The new mono hydrocyclone comprises a body containing a separation chamber and having first and second ends provided with first and second cylindrical external parts, respectively, the body also having a tangential inlet to the chamber. A third part screwed into said first end forms an axial outlet for a light separated component of the mixture to be separated, said second end forming a second axial outlet for the heavier separated component. Each cylindrical part of the body has a ring groove receiving a sealing ring. The sealing ring on said second cylindrical part is located between a thread on the corresponding end of the body and a collar at the side of said second cylindrical part which is nearer the first cylindrical part, the collar diameter increasing in the direction toward said first cylindrical part.

The new mono hydrocyclone may be readily mounted in aligned holes in a pair of concentric spaced standpipes of a multiple hydrocyclone. When so mounted, said first cylindrical part of the body is located in one of said holes which is of larger diameter than the other, the corresponding sealing ring engaging the surrounding annular wall of this larger hole. The second cylindrical part is located in the smaller hole defined by an annular wall engaged by the other sealing ring, and a nut is screwed onto said thread to clamp the corresponding standpipe against said collar.

Thus, the mono cyclone is fixed securely to the clamped standpipe by means which can be readily applied or released to permit easy replacement of individual mono cyclones. Also, the manner of mounting the mono cyclones in the holes of the standpipes permits thermal expansion and contraction of the mono cyclones while maintaining sealing contact between the sealing rings and the surrounding walls of the respective holes.

BRIEF DESCRIPTION OF THE DRAWINGS

For a better understanding of the invention, reference may be made to the following detailed description in conjunction with the accompanying drawings, in which.

DETAILED DESCRIPTION

Figure 1:
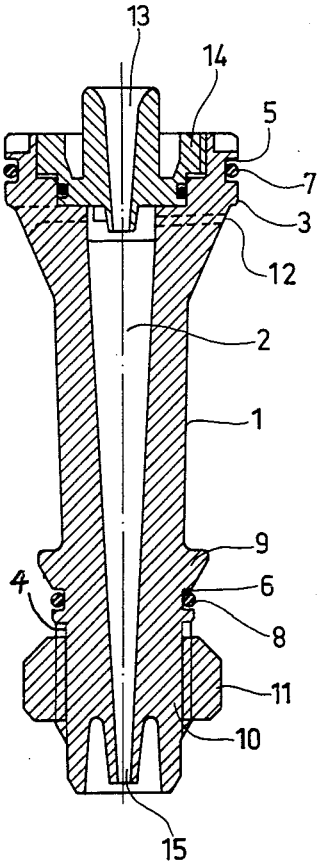
FIGS. 1 and 2 are longitudinal sectional views of two embodiments of the new mono hydrocyclone.

Referring to FIG. 1, the mono hydrocyclone there shown comprises a body 1 which is substantially rotationally symmetrical and contains a conical separation chamber 2. At one end of larger diameter the body 1 has a first external cylindrical part 3, the opposite end of smaller diameter having a second external cylindrical part 4. The two cylindrical parts 3 and 4 have ring grooves 5 and 6 in which sealing rings 7 and 8, respectively, are provided.

At the side of the second cylindrical part 4 located nearer the first part 3, the body 1 has a collar 9 which increases in diameter toward the first part 3. At the other side of second part 4 the body has a thread 10 with a nut 11 screwed thereon. Nut 11 is preferably bevelled at the side thereof nearer the collar 9.

Body 1 has a tangential inlet 12 leading to the larger end of conical chamber 2. A third part 14 is screwed into the larger end of the body and forms an axial outlet 13 for the separated lighter component of the mixture entering inlet 12. At its smaller end, the body 1 forms an axial outlet 15 for the separated heavier component.

Figure 2:
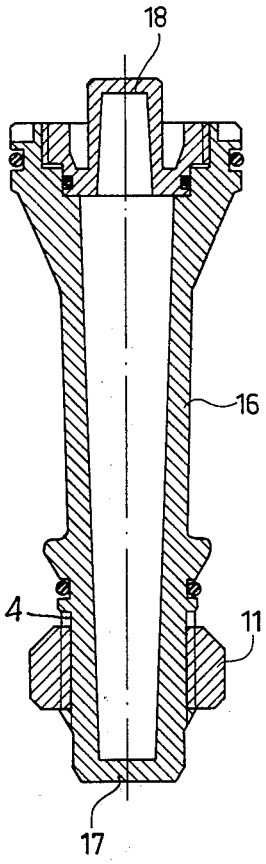

As shown in FIG. 2, the mono hydrocyclone has a dummy body 16 which is closed at both ends 17 and 18 and can be used to replace the unit shown in FIG. 1, as will be described presently.

Figure 3:
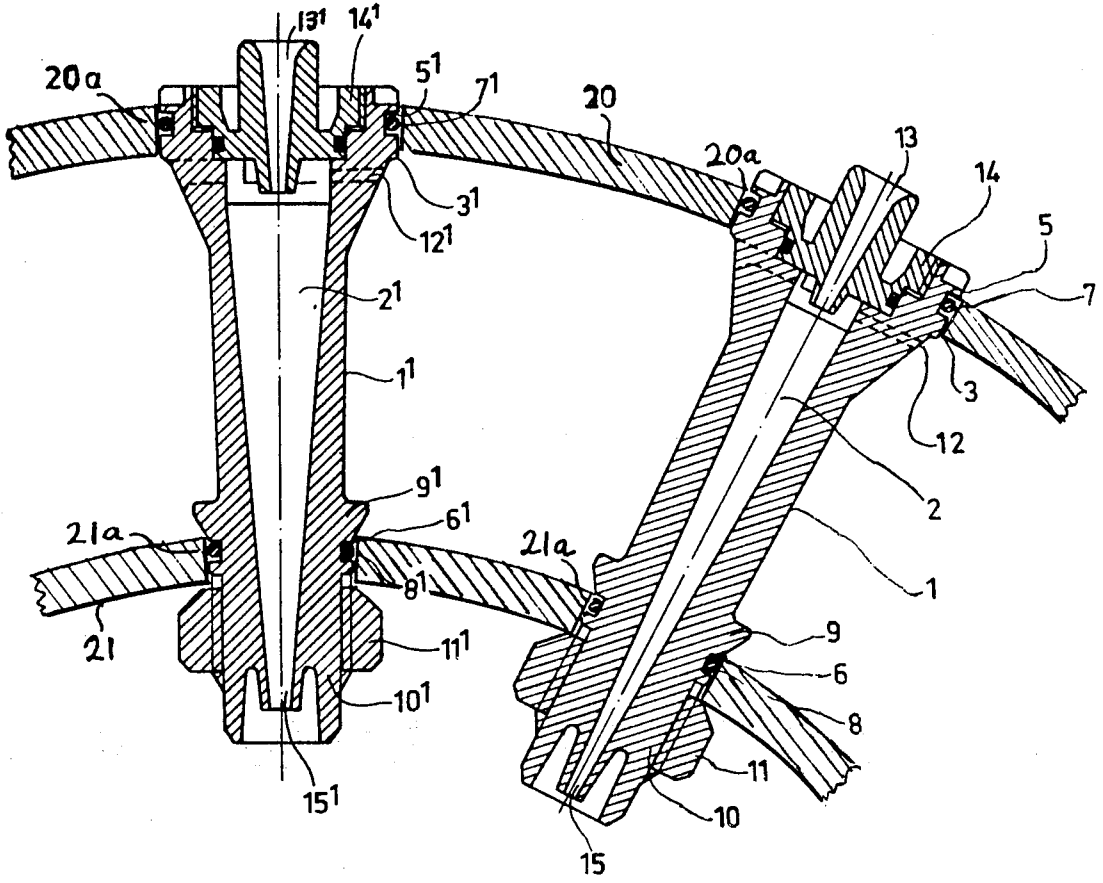
FIG. 3 is a similar view of two such cyclones mounted on concentric standpipes.

Referring to FIG. 3, two cyclone bodies 1 and 1' are shown mounted in a pair of spaced concentric standpipes 20 and 21 of a multiple hydrocyclone separator, the axes of these bodies extending radially of the standpipes and like spokes of a wheel, as disclosed in said U.S. Pat. No. 4,189,377. The cyclone unit with the body 1 is identical to the cyclone unit shown in FIG. 1; and the unit with body 1' is identical to that in FIG. 1 except that separation chamber 2', tangential inlet 12' and axial outlet 13' and 15' are wider than those in FIG. 1 to provide a greater capacity. All other elements 1', 3'–11' and 14' are identical to the corresponding elements 1, 3–11 and 14 in FIG. 1.

Standpipes 20 and 21 have two sets of aligned holes **20*a* and 21*a*, respectively. Holes 20*a* receive the first cylindrical parts 3 and 3' of the two cyclone bodies, while the smaller holes 21*a* receive the second cylindrical parts 4 and 4' of the resepctive bodies. The nuts 11 and 11' clamp standpipe 21 against the tapered parts of the respective collars 9 and 9', thereby holding the cyclone units securely against movement relative to pipe 21 and with the sealing rings 7–8 and 7'–8' engaging the annular walls defining the respective holes in the standpipes. However, the cylindrical parts 3 and 3' and their sealing rings 7 and 7' are free to slide in the respective holes 20*a* to accomodate thermal expansion and contraction of the bodies 1 and 1'** while maintaining the sealing action of the sealing rings.

To remove either of the cyclone units in FIG. 3, the nut 11 is removed and the unit is displaced to the right to the right so that the smaller end of body 1 is withdrawn first from hole **21*a* and then from hole 20*a*. To replace the unit, the smaller end of its body 1 is inserted first through hole 20***a* and then through hole 21*a* until collar 9 engages pipe 21, whereupon nut 11 is applied to clamp the unit to pipe 21.

It will be understood that the multiple hydrocyclone separator will include a substantial number of bodies 1 or bodies 1' or a combination of these different bodies mounted on the standpipes 20–21. Since the bodies 1 and 1' are identical in their external dimensions and configurations, they may be readily interchanged to provide a wide range of flow capacities and characteristics. In some instances, it may be desired to reduce the flow capacity by replacing one of the units in FIG. 3 with the dummy unit 16 shown in FIG. 2.

I claim:

1. A mono hydrocyclone for separating a mixture and comprising a body containing a separation chamber, said body having first and second ends provided with first and second cylindrical external parts, respectively, said body also having a tangential inlet to said chamber, a third part screwed into said first end and forming an axial outlet from the chamber for discharging a light separated component of said mixture, said second end forming a second axial outlet from the chamber, each of said cylindrical external parts having a ring groove extending around the part, a sealing ring in each of said grooves, said body having a collar adjacent the side of said second cylindrical part which is nearer the first cylindrical part, the diameter of said collar increasing toward said first cylindrical part, said second end of the body having an external thread adjacent the side of said second cylindrical part which is remote from the first cylindrical part, and a nut screwed onto said thread, a pair of concentric standpipes spaced from each other and having respective holes which are aligned with each other to receive said body, said first cylindrical part being located in one of said holes which is of substantially larger diameter than the other hole, said second cylindrical part being located in said other hole with the corresponding standpipe clamped between said collar and nut, said holes being defined by annular walls engaging said sealing rings, respectively.

2. The mono hydrocyclone of claim 1, in which said first cylindrical part is of substantially greater diameter than said second cylindrical part.

3. The mono hydrocyclone of claim 1, in which the maximum diameter of said collar exceeds the diameter of said second cylindrical part and the diameter of said thread.

4. The mono hydrocyclone of claim 3, in which said first cylindrical part is of substantially greater diameter than said second cylindrical part.

5. The combination of claim 1, comprising also a second mono hydrocyclone mounted in a second pair of aligned holes in the standpipes and being identical to the mono hydrocyclone of claim 1 except for the dimensions of said separation chamber and said inlet and outlets.

* * * * *